United States Patent [19]

Glover et al.

[11] 4,220,130

[45] Sep. 2, 1980

[54] SPRING TYPE BALL THROWING MACHINE

[75] Inventors: Clinton G. Glover; Harold A. Keller, both of Clarkston, Wash.

[73] Assignee: Cytron Incorporated, Lewiston, Id.

[21] Appl. No.: 885,433

[22] Filed: Mar. 10, 1978

[51] Int. Cl.[3] ..... F41B 7/00

[52] U.S. Cl. ..... 124/7; 124/41 R; 124/36

[58] Field of Search ..... 124/7, 8, 4, 9, 36, 124/41 R, 26; 273/26 D

[56] References Cited

U.S. PATENT DOCUMENTS

| | | | |
|---|---|---|---|
| 1,190,565 | 7/1916 | Long | 124/7 UX |
| 1,352,681 | 9/1920 | Nicols | 124/7 |
| 1,758,032 | 5/1930 | Dickman | 124/26 |
| 2,660,157 | 11/1953 | Binks | 124/7 |
| 2,660,158 | 11/1953 | Binks | 124/7 |
| 2,792,822 | 5/1957 | Ponza | 124/7 |
| 3,602,208 | 8/1971 | Huerlimann | 273/26 D X |
| 3,777,733 | 12/1973 | Mitchell | 124/7 |

FOREIGN PATENT DOCUMENTS

| | | | |
|---|---|---|---|
| 899184 | 5/1972 | Canada | 124/7 |

*Primary Examiner*—Richard C. Pinkham
*Assistant Examiner*—William R. Browne
*Attorney, Agent, or Firm*—Wells, St. John & Roberts

[57] ABSTRACT

A compact, light-weight machine for throwing balls along a desired trajectory includes a housing with an arcuate track leading inwardly from an opening to an initial ball support station. A throwing arm is rotatably mounted within the housing and is connected to a torsion spring. A crank arm is provided on one end of the shaft to rotate the torsion spring and throwing arm against a stop pin that extends through the housing in the path of the throwing arm. The torsion spring stores energy provided through the crank arm as it is rotated about a central axis. When the spring is sufficiently loaded, the throwing arm will slip from engagement with the stop pin and forcibly move against a ball to move it arcuately around the track and outwardly through the opening. The machine is specially adapted for use with resilient balls that will deform both against the track and against the throwing arm. The track will maintain the ball in a plane perpendicular to the central axis of rotation for the shaft and prevent rolling as the ball is moved by the throwing arm from the support station to an abrupt release point located inward of the opening. Once the ball leaves the abrupt release point, it may expand to its original geometry without contacting any other surfaces of the housing or throwing arm. An energy absorbing feature is also provided to take up at least some of the momentum of the spring as it moves past the release point and toward the stop pin. This prevents stress reversal and lengthens the useful life of the spring and throwing arm.

13 Claims, 7 Drawing Figures

SPRING TYPE BALL THROWING MACHINE

BACKGROUND OF THE INVENTION

The present invention is related broadly to the field of mechanical projecting apparatus and more particularly to such apparatus utilized for projecting balls through use of mechanical springs and centrifugal force.

Various machines have been designed for use in mechanically throwing balls for batting practice and catching in various sports. Such machines are typically complex in design and are often too dangerous to be utilized by small children. The complex nature of typical pitching machines necessarily renders them both expensive to purchase and difficult to maintain.

Plastic safety balls can be batted in gymnasiums, basements, and small yards without danger of breaking windows or causing personal injury as could be the case with baseballs or even lighter weight tennis balls. This is due to rapid velocity fade and low density of these balls. However, the same properties that make the safety balls safe, also make them difficult to throw fast enough by hand to challenge skilled players. There are existing pitching machines for throwing plastic balls, but they are complex and economically unreasonable for most private sports enthusiasts. Further, some devices present safety hazards for young players due to the use of electrically-driven motors to provide energy for propelling the balls.

It therefore becomes desirable to provide some form of ball-throwing device that is extremely simple in construction, compact in size, and safely and easily operated by youngsters.

DETAILED DESCRIPTION OF A PREFERRED EMBODIMENT

Figure 1:
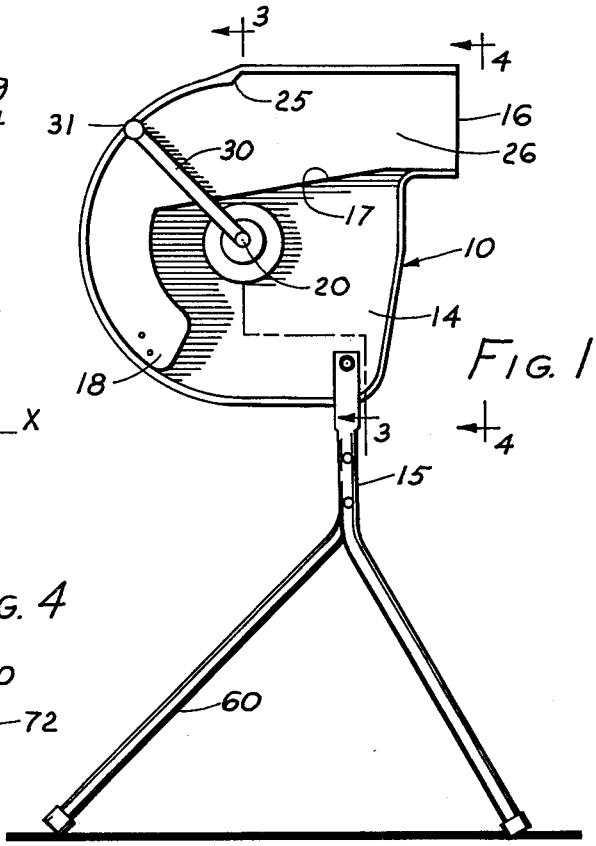
FIG. 1 is a side elevational view of the present ball-throwing machine.
Figure 4:
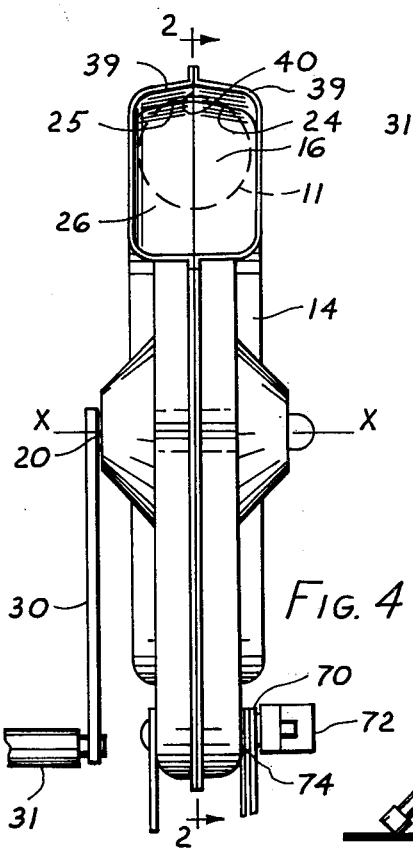
FIG. 4 is a frontal elevation view.
Figure 2:
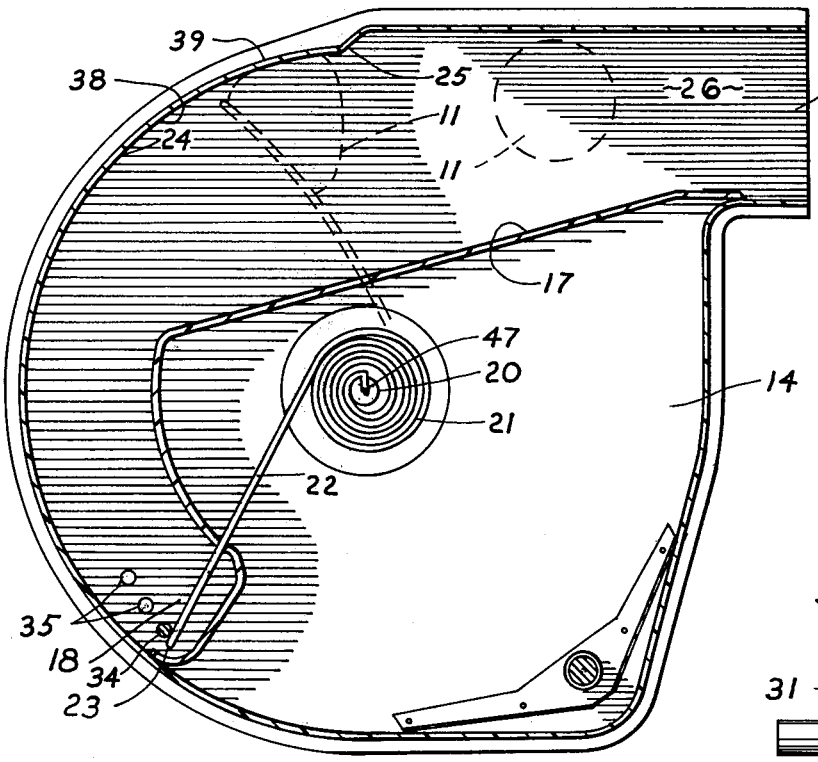
FIG. 2 is a sectional view taken substantially along line 2—2 in FIG. 4.

A machine embodying the principles of the present invention is illustrated in FIG. 1 and is designated therein by the reference character 10. The machine 10 is designed to project balls such as that shown at 11 (dashed lines) in FIGS. 2 and 3. Such balls may be of the type utilized in playing various games such as baseball or tennis and particularly plastic "safety" balls such as "Wiffle Balls" (TM) that are utilized in batting practice and catching in confined areas. Such balls are resilient, light weight, and therefore difficult to pitch with any accuracy or velocity. Further, such balls have a low coefficient of friction over their outer surfaces. The present machine 10 is designed preferably for utilization with such resilient practice balls that will deform upon forceful contact as shown in FIG. 2 and subsequently regain their original geometry.

the present machine 10 includes a hollow housing 14 mounted on a ground-supported base 15. Housing 14 includes an opening 16 that serves as a discharge for balls thrown by the machine and as an access opening for loading successive balls into the machine.

A loading ramp 17 (FIG. 2) is formed integrally within the housing 14 leading from the opening 16 to an initial ball-receiving and support station 18. The loading ramp is inclined with respect to a horizontal plane to allow balls to roll downwardly to the station 18. Ramp 17 will be downwardly inclined even if the opening 16 is aimed downwardly to facilitate throwing of "ground balls" during catching practice in baseball.

Figure 3:
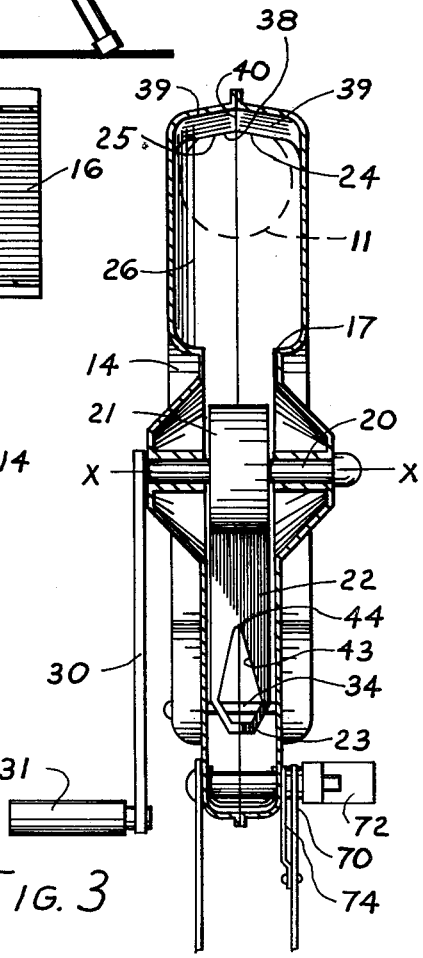
FIG. 3 is a sectional view taken along line 3—3 in FIG. 1.

A horizontal shaft 20 is mounted within the housing 14 for rotation about a central axis X—X (FIG. 3). A torsion spring means 21 and throwing arm 22 are connected with shaft 20 for common rotation about the axis X—X. Throwing arm 22 extends to an outward end 23 that is located radially inward of an arcuate track 24 of housing 14. The throwing arm 22 moves in a circular path along the arcuate track 24 from the initial ball-receiving and support station 18 past an abrupt release point 25 along track 24. Full rotation of the throwing arm 22 moves the outward end 23 in a full circule from the station 18 back to the same station to define a circular path that is totally enclosed by housing 14.

The housing opening 16 is situated outwardly of the abrupt release point 25. An expansion chamber 26 is defined by the housing 14 between opening 16 and abrupt release point 25. Chamber 26 shrouds the throwing arm 22 as it moves past the point 25 and enables expansion or recovery of a ball to its original spherical geometry (FIG. 2). It has been found that resilient balls will deform against the throwing arm and track as shown by FIG. 2. Therefore, the expansion chamber is necessary to allow for free recovery of the balls to their original geometry. Otherwise, should the track continue along a tangent without an abrupt release point, the balls would expand against the track and the resultant trajectory would be difficult if not impossible to predict. With the present abrupt release point 25 and expansion chamber 26, resilient balls are allowed to expand freely to return to their original geometry without engagement by the track 24. Trajectory of the ball may be therefore accurate and consistent. Safety is assured as the housing protectively encloses the throwing arm as it passes by the expansion chamber.

Means is provided for selectively rotating the shaft 20 about axis X—X in order to load the torsion spring means 21 and subsequently force the throwing arm 22 about its circular path. This means may be provided in the form of a crank arm 30 having a handle grip 31 at an outward end. Handle grip 31 may be weighted to present a concentration of mass at the end of crank arm 30 to resist reaction forces exerted by the torsion spring 21 after releasing a ball through the opening 16. The inertia of the weighted handle grip 31 will not be easily overcome by the torsional forces acting against the shaft 20. The spatial relationship of the handle, throwing arm, abrupt release point and ball receiving station is such that when the handle is in a free position as shown in FIG. 3, as determined by gravity, the loading ramp will be free from obstruction. Further, the relationship is such that the crank will be moving in a downward direction as loading of the torsion spring means reaches a maximum value prior to its release.

The throwing arm 22 is triggered by means for engaging and preventing rotation of the throwing arm as the shaft 20 is rotated. It may include a stop pin 34 located within the housing adjacent to the ball receiving and support station and spaced inwardly of the outer throwing arm end 23. The pin 34 will thereby enable torsional loading of the torsion spring means 21 to a prescribed amount, then release the throwing arm and allow the spring means 21 to unload, driving the throwing arm along its circular path to engage a ball and forcibly move it along track 24 toward the opening 16.

The stop pin 34 is releasably mounted to the housing 14 to selectively prevent rotation of the throwing arm as it comes into engagement therewith. A series of radialy spaced apertures 35 are provided to receive stop pin 34 to enable selective loading for the spring means 21. Of course, the closer the pin 34 is located toward axis X—X, the more the spring 21 will load before the throwing arm will be released. Similarly, an aperture 35 situated directly adjacent to the track 24 may receive the stop pin 34 to engage the throwing arm and require less loading of the spring 21 and consequently a lower resultant ball velocity.

A ball 11 moving about track 24 will be automatically positioned by a ball guide means formed integrally with the track 24. The guide means may include a concave surface 38 extending along the track between station 18 and abrupt release point 25. The concave surface 38 as shown in FIG. 3 is formed by two surfaces 39 that face the shaft and are inclined from the axis X—X. The surfaces 39 come together at a juncture 40 that lies along a perpendicular plane to the axis X—X. Therefore, a ball moving along the track over the concave surface 38 will be centered along the plane. Resilient balls will be easily centered as they deform against the concave surface due to centrifugal force. It is intended that the concave surface have a low coefficient of friction to facilitate sliding of the ball rather than rolling. Thus rotation of balls leaving the machine is minimized and will follow a trajectory substantially free of spin induced curvature.

Figure 5:
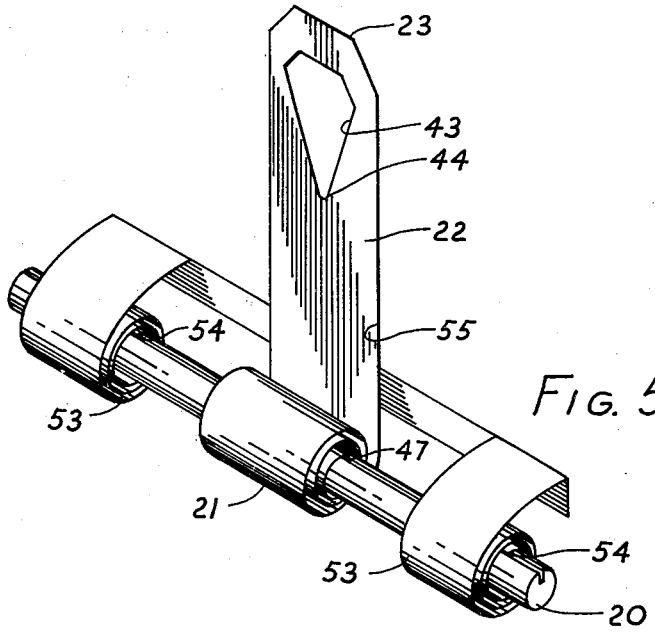
FIG. 5 is a fragmentary pictorial view illustrating a particular form of torsion spring means and energy-absorbing means for the present ball-throwing machine.
Figure 6:
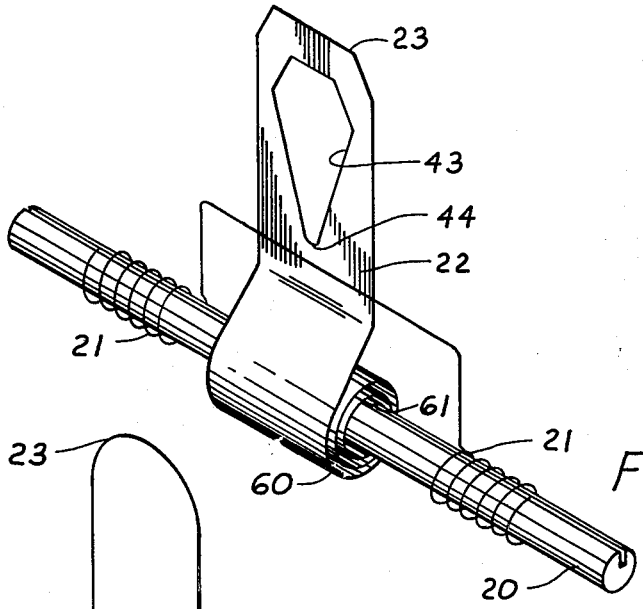
FIG. 6 is another alternate arrangement of the elements shown in FIG. 5.
Figure 7:
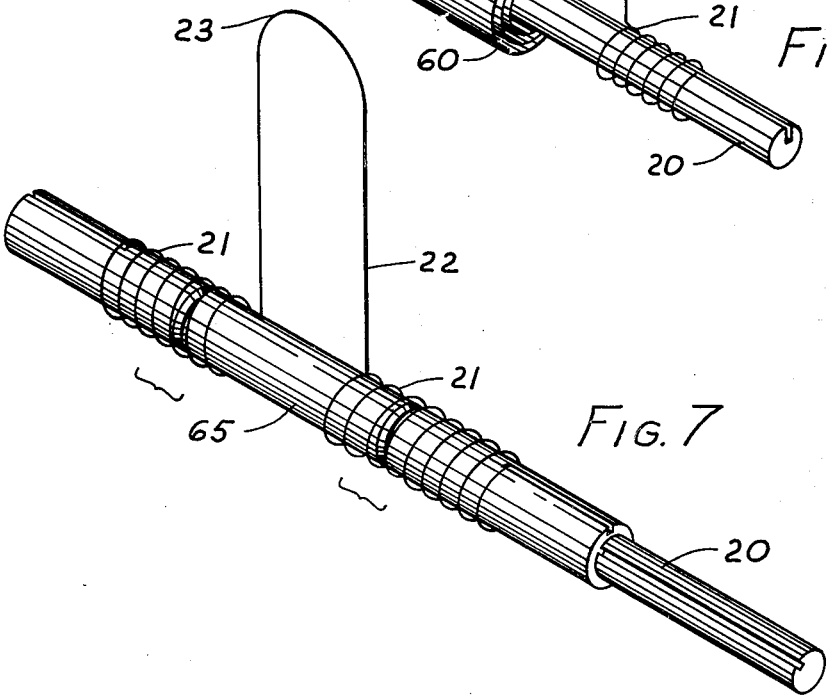
FIG. 7 is a similar view illustrating yet another form.

FIGS. 2 and 3 illustrate the throwing arm 22 and torsion spring means 21 as being integral. FIGS. 5 through 7, however, illustrate alternate arrangements of the torsion spring means and throwing arm. Also included in the preferred and alternate forms is an energy-absorbing means for minimizing stress reversal in the spring means as it unloads.

In FIGS. 2 and 3 in the preferred form, torsion spring means 21, throwing arm 22 and the energy absorbing means are integral in a single wound strap of spring metal. The torsion spring means 21 is formed by winding the strap about the shaft 20 in a direction opposite to the intended direction of rotation for the throwing arm 22. The throwing arm 22 is an integral extension of the spring means, extending substantially radially outward to its outward end 23. A cut-out area 43 is provided in the throwing arm 22 adjacent its outward end 23. The cut-out area 43 tapers or converges to a small radius 44 adjacent the torsion spring means 21. Cut-out area 43 provides a variable section modulus along the length of the throwing arm thereby stressing it to approximately the same level as the coiled portion for greater energy storage and therefore greater velocity of the ball contact area of the throwing arm. The stress is equalized along the throwing arm and torsion spring means by proportioning the section modulus to the bending moment applied along the length of the throwing arm. Cut-out area 43 also reduces the mass of the throwing arm at its outward end to reduce the mass that is accelerated and subsequently decelerated to maximize velocity and to reduce stress reversal within the throwing arm once it leaves forcible engagement with a ball and moves beyond the abrupt release point 25. The strap material may be formed of a heavy spring metal that is designed to withstand stress reversal of the type encountered when a spring is loaded and suddenly unloaded and allowed to go beyond a normal state to a stress reversal situation wherein the coils of the spring tend to unwind. By lowering the section modulus and mass of the throwing arm at its outward end, and by providing appropriate material for the spring means 21, we are able to reduce the stress reversal to a minimum value. It is important to minimize fatigue and thereby increase the operational life of the spring and remaining elements associated therewith.

As shown in FIG. 2, the torsion spring means 21 is keyed to the shaft 20 at an end 47. Therefore, the spring 21 will load or unload in response to rotation of the shaft 20. Similarly, the throwing arm 22 will move in its circular path within housing 14 in response to unloading or loading of the spring means 21, except for resistance offered by the stop pin 34. The spring means 21 of FIG. 2 will begin to load as the shaft 20 is turned after throwing arm 22 comes into contact with the stop pin 34. As the spring continues to load, it contracts radially and pulls the throwing arm radially inward. When a prescribed load level is reached the outward end 23 of throwing arm 22 will slip over the stop pin 34 and forcibly engage a ball resting at the initial ball receiving and support station 18.

Torsional unloading of the spring forces the throwing arm on around its circular path from the station 18 to the abrupt release point 25. If the ball is resilient, the forces acting upon it will cause it to substantially deform and take the shape of the concave surface 38 and throwing arm 22 as shown in dashed lines in FIG. 2. The ball will not roll or rotate due to its frictional engagement between the two surfaces.

The ball will be forcibly released at the abrupt release point 25 and will move outwardly through opening 16 at substantially high velocity. It will regain its original geometry upon leaving contact with the throwing arm and track as it passes freely through the expansion chamber.

The throwing arm will have attained a certain momentum at the release point 25 which will tend to forcibly carry it and the spring on around to the stop pin. This momentum in the direction of throwing arm travel would ordinarily cause a stress reversal situation, loading the spring in a direction opposite its windings. However, the cut-out area 43 reduces the momentum by lowering mass at the end of throwing arm 22 and the heavy spring material will function as means for absorbing such energy to prevent excessive stress reversal.

By the preferred combination of integral throwing arm, torsion spring means and energy absorbing means, we are able to produce an effective ball throwing machine that is light weight and compact. In fact, machines have been produced that will throw a plastic safety ball at a velocity of 68 m.p.h. with throwing arm radii (from the shaft axis X—X) of less than 15 inches and preferably about 7 inches. Such machines weigh in the vicinity of 12 pounds.

The particular configuration illustrated in FIG. 5 shows the torsion spring means 21 and throwing arm 22 as being integral and connected to the shaft 20. However, a separate energy-absorbing means is provided in the form of an oppositely wound torsion spring 53 fixed to the shaft at ends 54 and connected to the throwing arm 22 at a point 55 along its length. During assembly, the two oppositely wound springs may be mounted to shaft 20 with each being slightly loaded and acting against resistance of the other. As the ball leaves the release point 25, the throwing arm will continue to rotate about the axis X—X toward the stop pin 34. Momentum will carry the arm or attempt to carry it beyond its normal unloaded condition. At this point the spring 53 will come back into engagement with the throwing arm and resist movement of the throwing arm beyond its normal condition, thereby absorbing the mementum and preventing undesired stress reversal.

Another alternate example of the energy-absorbing means, throwing arm, and torsion spring means is illustrated in FIG. 6. Here, the energy-absorbing means and throwing arm are integral while the torsion spring means 21 is independently operable to exert force against the throwing arm. The energy-absorbing means is comprised of a spring 60 wound in the intended directional movement for the throwing arm. It includes an end 61 mounted to the shaft and an opposite end forming the throwing arm 22. The torsion spring means 21 is also fixed to the shaft and extends outwardly to engage the throwing arm 22 in order to operate against the throwing arm to forcibly move it and a ball along the track to the opening 16. As discussed above, the two independent springs may be assembled on the shaft 20 in a pre-loaded condition with one being urged against the other. The same resultant energy absorption will thereby occur upon release of a ball and in response to forward momentum of the throwing arm that would tend to carry it and the attached torsion spring means beyond a normal unloaded condition. Further if the groove in the shaft 20 as shown in both FIGS. 5 and 6 is made wider with respect to the engaging portion of the spring, a region of free travel is provided allowing further loading of one spring without reverse loading of the opposing spring.

FIG. 7 illustrates a wire spring that may be also utilized with the present machine. This figure, however, is presented primarily to illustrate a wear-preventing sleeve 65 that is rotatably mounted to shaft 20 for engagement by the torsion spring means 21. The sleeve 65 may be utilized with any form of the torsion spring means 21 or energy-absorbing means whether it be integral with the spring and throwing arm as shown in FIG. 2 or separate as shown in FIGS. 5 and 6. In any case the inward ends of the spring are affixed to the shaft and the windings are situated about the rotatable sleeve 65. When the throwing arm 22 comes into contact with stop pin 34, the associated torsion spring means 21 will begin to load, winding on itself, to a compact condition. As this happens the spring will engage the sleeve 65 and rotate it independently of the shaft 20. This reduces wear on the spring by preventing concentrated frictional rubbing engagement of the spring on a small area of shaft 20.

The entire machine 10 is supported at a selected above-ground elevation by the base 15 which includes three support legs 60. The legs 60 are arranged to brace the machine against the forces produced by a user turning the crank arm 30 and by the machine in throwing a ball 11. The housing is mounted to the legs 60 through means of an angular adjustment assembly that facilitates angular adjustment of the housing 14 to selectively determine the trajectory of a ball 11. It includes a selectively operable brake 70 controlled by the lever 72. Brake plates 74 are provided between the lever 72 and housing 14. The lever may be turned to exert clamping force against the plates to thereby secure the legs relative to housing 14.

The above description has been given by way of example to set forth a preferred form of the invention. The scope of the invention, however, is set forth only by the following claims.

What we claim is:

1. A machine for throwing lightweight resilient balls, comprising:

a hollow housing;

a base for supporting the housing;

an arcuate track within the housing generated about a central axis;

an abrupt ball release point formed within the housing along the arcuate track;

an opening within the housing adjacent the ball release point;

an initial ball receiving and support station within the housing at a location therein angularly spaced about the central axis from the opening;

a shaft extending through the housing along the center axis and rotatable therein about the center axis;

means for selectively rotating the shaft about the center axis;

a throwing arm operatively mounted to the shaft for rotation about the central axis and including an outward end spaced radially inward of the arcuate track for engaging a ball at the initial ball receiving and support station and moving it along the arcuate track to the ball release point;

torsion spring means mounted to the shaft and operatively connected to the throwing arm, for torsional loading in response to rotation of the shaft and for suddenly unloading against the throwing arm, causing it to rotate forcibly about the central axis and forcibly move a ball against the track from the receiving and support station to the release point;

stop means mounted to the housing adjacent the ball receiving and support station spaced radially inward of the outward throwing arm end for initially engaging and preventing rotation of the throwing arm as the shaft is rotated to enable torsional loading of the torsion spring means and to release the throwing arm as torsional loading reaches a prescribed level allowing unloading of the torsion spring means against the throwing arm;

an energy-absorbing spring means in the rotational path of the throwing arm and connected to the shaft on both sides of the throwing arm for retarding the movement of the throwing arm after the throwing arm engages the energy-absorbing spring means and during the time it moves beyond the ball release point, thereby minimizing stress reversal in the torsion spring means; and ball guide means along the arcuate track for maintaining a ball in a plane perpendicular to the central axis along the track as it is moved from the ball receiving and supporting station to the ball release point.

2. The ball throwing machine as defined by claim 1 wherein the throwing arm, torsion spring means, and energy absorbing means are integral and wherein the throwing arm includes a cut-out area adjacent its outward end tht converges inwardly toward the central axis.

3. The ball throwing machine as defined by claim 1 wherein the stop means includes a pin releasably received within the housing and wherein the housing includes radially spaced apertures adapted to selectively receive the pin.

4. The machine as defined by claim 1 wherein the ball guide means is comprised of a transversely concave surface facing the shaft formed integrally with the arcuate track and symmetrical to a plane perpendicular to the central axis.

5. The ball throwing machine as defined by claim 1 further comprising angular adjustment means interconnecting the base and housing for securely holding the housing at selected angular positions to vary the trajectory of a ball thrown by the machine.

6. The ball throwing machine as defined by claim 1 further comprising a ball loading ramp formed within the housing and leading from the opening to the initial ball receiving and support station.

7. The ball throwing machine as defined by claim 1 wherein the means for selectively rotating the shaft about the center axis is comprised of a crank arm mounted to the shaft at one end and having a weighted handle grip at an opposite end.

8. The ball throwing machine as defined by claim 1 wherein the ball release point is enclosed within the housing inward of the opening and wherein the throwing arm moves about a circular path defined by it outward end, said path being enclosed within the housing inward of the opening.

9. A machine as defined by claim 1 further comprising:

a ball expansion chamber between the ball release point and the opening to allow a resilient ball, previously distorted against the track and throwing arm by forcible engagement with the throwing arm, to freely return to its original shape.

10. The machine as defined by claim 1 wherein:

the throwing arm is actuated by the torsion spring means to engage and accelerate a ball along the arcuate track such that the ball is deformed against the track and will not rotate during acceleration.

11. The ball throwing machine as defined by claim 10 wherein the arcuate track is formed along a radius from the central axis of less than fifteen inches.

12. The machine as defined by claim 1 further comprising:

a ball loading ramp formed within the housing and leading from the opening to the initial ball receiving and support station;

wherein the means for selectively rotating the shaft about the central axis is comprised of a crank arm mounted to the shaft at one end and having a handle grip at an opposite end;

wherein the handle grip and throwing arm, are angularly spaced about the central axis such that when the handle grip is in a free position as determined by gravity, the throwing arm will not obstruct the loading of a ball along the loading ramp.

13. The machine as defined by claim 12 wherein the handle grip, throwing arm, ball receiving station, and loading ramp are angularly spaced about the central axis so an actuating force applied to the handle grip is oriented in a downward direction as loading of the torsion spring means against the stop means approaches a maximum value.

* * * * *